US007645031B2

(12) United States Patent
Enomoto et al.

(10) Patent No.: US 7,645,031 B2
(45) Date of Patent: Jan. 12, 2010

(54) LIQUID EJECTION HEAD, METHOD OF MANUFACTURING LIQUID EJECTION HEAD, AND IMAGE FORMING APPARATUS

(75) Inventors: Katsumi Enomoto, Kanagawa-ken (JP); Yasuhiko Maeda, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 410 days.

(21) Appl. No.: 11/812,040

(22) Filed: Jun. 14, 2007

(65) Prior Publication Data

US 2008/0002001 A1 Jan. 3, 2008

(30) Foreign Application Priority Data

Jun. 22, 2006 (JP) ..... 2006-172993

(51) Int. Cl.
*B41J 2/045* (2006.01)

(52) U.S. Cl. ..... 347/71

(58) Field of Classification Search ..... 347/71, 347/68–70, 72; 400/124.16, 124.17; 310/323, 310/324, 367; 29/25.35
See application file for complete search history.

(56) References Cited

U.S. PATENT DOCUMENTS 7,537,320 B2 * 5/2009 Sugahara ..... 347/70
2002/0140786 A1 * 10/2002 Sugahara ..... 347/72

FOREIGN PATENT DOCUMENTS

JP 2003-182076 A 7/2003
JP 2005-254616 A 9/2005

* cited by examiner

*Primary Examiner*—K. Feggins
(74) *Attorney, Agent, or Firm*—Birch, Stewart, Kolasch & Birch, LLP

(57) ABSTRACT

The liquid ejection head includes: a liquid ejection unit which includes nozzles ejecting liquid, pressure chambers connected with the nozzles and filled with the liquid, and piezoelectric elements pressurizing the liquid in the pressure chambers; a frame substrate which has a hole section passing through the frame substrate and is disposed on a side of the liquid ejection unit reverse to a side on which the nozzles are arranged, the hole section being defined with a lateral wall and corresponding to a common liquid chamber accumulating the liquid to be supplied to the pressure chambers; a cover plate which is arranged on a side of the frame substrate reverse to a side adjacent to the liquid ejection unit; and through electrodes which pass through the lateral wall of the frame substrate and are exposed on the side adjacent to the liquid ejection unit and the side adjacent to the cover plate, wherein the piezoelectric elements are applied with drive signals via the through electrodes.

11 Claims, 15 Drawing Sheets

LIQUID EJECTION HEAD, METHOD OF MANUFACTURING LIQUID EJECTION HEAD, AND IMAGE FORMING APPARATUS

BACKGROUND OF THE INVENTION

1. Field of the Invention

The present invention relates to a liquid ejection head, a method of manufacturing a liquid ejection head, and an image forming apparatus, and more particularly, to wiring technology for electrical wires in a liquid ejection head.

2. Description of the Related Art

As an image forming apparatus, an inkjet printer (inkjet recording apparatus) has been commonly known, which includes an inkjet head (liquid ejection head) having a plurality of nozzles, and which records an image on a recording medium by ejecting ink (liquid) from the nozzles toward the recording medium while causing the inkjet head and the recording medium to move relatively to each other.

The inkjet head is, for example, principally constituted of: a common liquid chamber, which accumulates ink supplied from an ink tank; pressure chambers, which store ink supplied from this common liquid chamber; piezoelectric elements, which deform a diaphragm constituting one lateral wall defining the pressure chambers; and nozzles, which are connected to the pressure chambers. By supplying a prescribed drive signal to the piezoelectric element, the ink in the pressure chamber is pressurized and the ink is ejected from the nozzle in the form of a droplet.

In the inkjet head, various methods have been proposed for arranging the electrical wires and drive integrated circuit (IC) chips required to transmit drive signals to the piezoelectric elements, with a view to reducing the number of components, the manufacturing costs, and the size of the inkjet head.

For example, Japanese Patent Application Publication No. 2003-182076 discloses that IC chips forming drive circuits are fixed on a bonding substrate that covers the piezoelectric elements, the IC chips are mutually connected through wire bonding, and the IC chips and corresponding electrodes are also connected through wire bonding, so that the installation surface area of the IC chips can be reduced and the inkjet head can be made more compact. In this composition, however, since the connections between the IC chips and the connections between the IC chips and corresponding electrodes are made by wire bonding, then in an apparatus (e.g., a printer) that has moving mechanisms, there may be a possibility of disconnection due to vibrations or impacts, and therefore reliability is poor. Moreover, there are problems of workability and work efficiency in connecting the wire bonds, in view of the structure in which the electrodes to be connected with wire bonding are located on the bottom faces of recessed portions. Furthermore, since the structure is adopted in which the common liquid chamber is arranged on a lateral side of the pressure chamber, then the nozzle row and the common liquid chamber are required to be arranged alternately in order to arrange the nozzles in a matrix configuration for the purpose of increasing the nozzle density, resulting in the increased size of the head.

Japanese Patent Application Publication No. 2005-254616 discloses that a wall defining a common liquid chamber is partially formed of a flexible printed circuit (FPC) sheet, or the like, so that it is possible to reduce the overall size of the head of the inkjet printer. In this composition, however, similarly to the composition described in Japanese Patent Application Publication No. 2003-182076, since it is necessary to connect the wire bonds to the bottom faces of recessed portions in structural terms, then reliability may become poor and problems of work efficiency may also arise. Moreover, since the head is connected with external circuits through the flexible printed circuit having wires formed at high density, then the installation space of the head is accordingly increased.

SUMMARY OF THE INVENTION

The present invention has been contrived in view of these circumstances, an object thereof being to provide a liquid ejection head and an image forming apparatus, whereby the liquid ejection head can be reduced in size, the number of components can be reduced while achieving high nozzle density, and costs can thereby be reduced. A further object of the present invention is to provide a method of manufacturing a liquid ejection head whereby the reliability of the electrical connections is improved while reducing the number of electrical connection tasks required.

In order to attain the aforementioned object, the present invention is directed to a liquid ejection head, comprising: a liquid ejection unit which includes nozzles ejecting liquid, pressure chambers connected with the nozzles and filled with the liquid, and piezoelectric elements pressurizing the liquid in the pressure chambers; a frame substrate which has a hole section passing through the frame substrate and is disposed on a side of the liquid ejection unit reverse to a side on which the nozzles are arranged, the hole section being defined with a lateral wall and corresponding to a common liquid chamber accumulating the liquid to be supplied to the pressure chambers; a cover plate which is arranged on a side of the frame substrate reverse to a side adjacent to the liquid ejection unit; and through electrodes which pass through the lateral wall of the frame substrate and are exposed on the side adjacent to the liquid ejection unit and the side adjacent to the cover plate, wherein the piezoelectric elements are applied with drive signals via the through electrodes.

According to this aspect of the present invention, the drive electrodes (individual electrodes) of the piezoelectric elements are extended to the side of the cover plate via the through electrodes formed in the lateral wall of the frame substrate, and hence it is possible to ensure sufficient mounting surface area for the electrical wires, the IC chips, and the like, without increasing the size of the liquid ejection head, and the nozzle density of the liquid ejection head can be increased while making the liquid ejection head more compact in size. Furthermore, the through electrodes are formed integrally with the frame substrate that constitutes the lateral wall defining the common liquid chamber, and hence it is possible to reduce the number of components and to lower the costs.

Preferably, the frame substrate includes: a frame member through which the hole section is formed; and a wall member which has grooves corresponding to the through electrodes and is bonded on a lateral face of the frame member.

According to this aspect of the present invention, it is possible to compose the through electrodes having a high aspect ratio, and hence a high-density head (a head having a high nozzle density) can be obtained. Moreover, it is also possible to obtain a large capacity in the common liquid chamber, and to achieve stable ejection of a high-viscosity liquid, as well as preventing cross-talk through the liquid.

Preferably, the liquid ejection head further comprises a selection circuit which is mounted on the cover plate and selects the piezoelectric elements to be applied with the drive signals.

According to this aspect of the present invention, it is possible to connect the piezoelectric elements to the drive circuit that generates the drive signals by using a low density wiring. Hence, it is possible to reduce the size of the liquid ejection head and to reduce the costs. Moreover, since the selection circuit is mounted on the cover plate, which constitutes a wall (upper wall) defining the common liquid chamber, it is then possible to efficiently transfer heat generated from the selection circuit to the liquid accumulated in the common liquid chamber, and furthermore, this transferred heat serves to reduce variations in the viscosity of the liquid accumulated in the common liquid chamber, thereby enabling stable ejection.

Preferably, the cover plate has a groove on a side adjacent to the common liquid chamber.

According to this aspect of the present invention, the thin section of the cover plate in the position corresponding to the groove section functions as a damper which deadens the pressure wave propagating in the common liquid chamber, and hence it is possible to prevent fluid cross-talk caused by liquid ejection.

In order to attain the aforementioned object, the present invention is also directed to a method of manufacturing a liquid ejection head including: a liquid ejection unit which includes nozzles ejecting liquid, pressure chambers connected with the nozzles and filled with the liquid, and piezoelectric elements pressurizing the liquid in the pressure chambers; a frame substrate which has a hole section passing through the frame substrate and is disposed on a side of the liquid ejection unit reverse to a side on which the nozzles are arranged, the hole section being defined with a lateral wall and corresponding to a common liquid chamber accumulating the liquid to be supplied to the pressure chambers; a cover plate which is arranged on a side of the frame substrate reverse to a side adjacent to the liquid ejection unit; and through electrodes which pass through the lateral wall of the frame substrate and are exposed on the side adjacent to the liquid ejection unit and the side adjacent to the cover plate, the piezoelectric elements being applied with drive signals via the through electrodes. The method comprises the steps of: forming the liquid ejection unit, the frame substrate and the cover plate, independently of each other; then bonding together the liquid ejection unit, the frame substrate and the cover plate; and then simultaneously and electrically connecting electrical wires of the liquid ejection unit with electrical wires of the cover plate via the through electrodes.

According to this aspect of the present invention, the bonding step and the electrically connecting step are completely separated from each other, and hence the reliability of each step is improved. Moreover, in the electrically connecting step, the wires in the liquid ejection unit are simultaneously connected electrically to the corresponding wires in the cover plate, by means of the through holes, and hence the number of manufacturing steps can be reduced and the reliability of the electrical connections can be improved.

Preferably, the connecting step includes the step of filling conductive paste into through holes corresponding to the through electrodes by vacuum printing. Alternatively, it is also preferable that the connecting step includes the step of applying electrolytic plating for through holes corresponding to the through electrodes.

According to these aspects of the present invention, the process of filling conductive paste or the process of applying electrolytic plating may be adopted in the electrically connecting step. In each process, it is possible to ensure the reliability of the electrical connections by means of a small number of manufacturing steps.

Preferably, the forming step includes the step of bonding a wall member which has grooves corresponding to the through electrodes onto a lateral face of the frame member through which the hole section is formed.

According to this aspect of the present invention, it is possible to form the through electrodes (through holes) having a high aspect ratio.

Preferably, the forming step includes the step of forming at least one of the wall member and the frame member by die molding.

According to this aspect of the present invention, it is possible to achieve inexpensive mass production of the constituent members (the frame member and the wall member) of the frame substrate.

Preferably, the forming step includes the step of forming the wall member by imprinting.

According to this aspect of the present invention, it is possible to achieve inexpensive mass production of the wall member. Moreover, it is also possible to manufacture the wall member having a large number of fine grooves, at high density.

In order to attain the aforementioned object, the present invention is also directed to an image forming apparatus comprising the above-described liquid ejection head.

According to the present invention, the drive electrodes (individual electrodes) of the piezoelectric elements are extended to the side of the cover plate via the through electrodes formed in the lateral wall of the frame substrate, and hence it is possible to ensure sufficient mounting surface area for the electrical wires, the IC chips, and the like, without increasing the size of the liquid ejection head, and the nozzle density of the liquid ejection head can be increased while making the liquid ejection head more compact in size. Furthermore, the through electrodes are formed integrally with the frame substrate that constitutes the lateral wall defining the common liquid chamber, and hence it is possible to reduce the number of components and to lower the costs.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
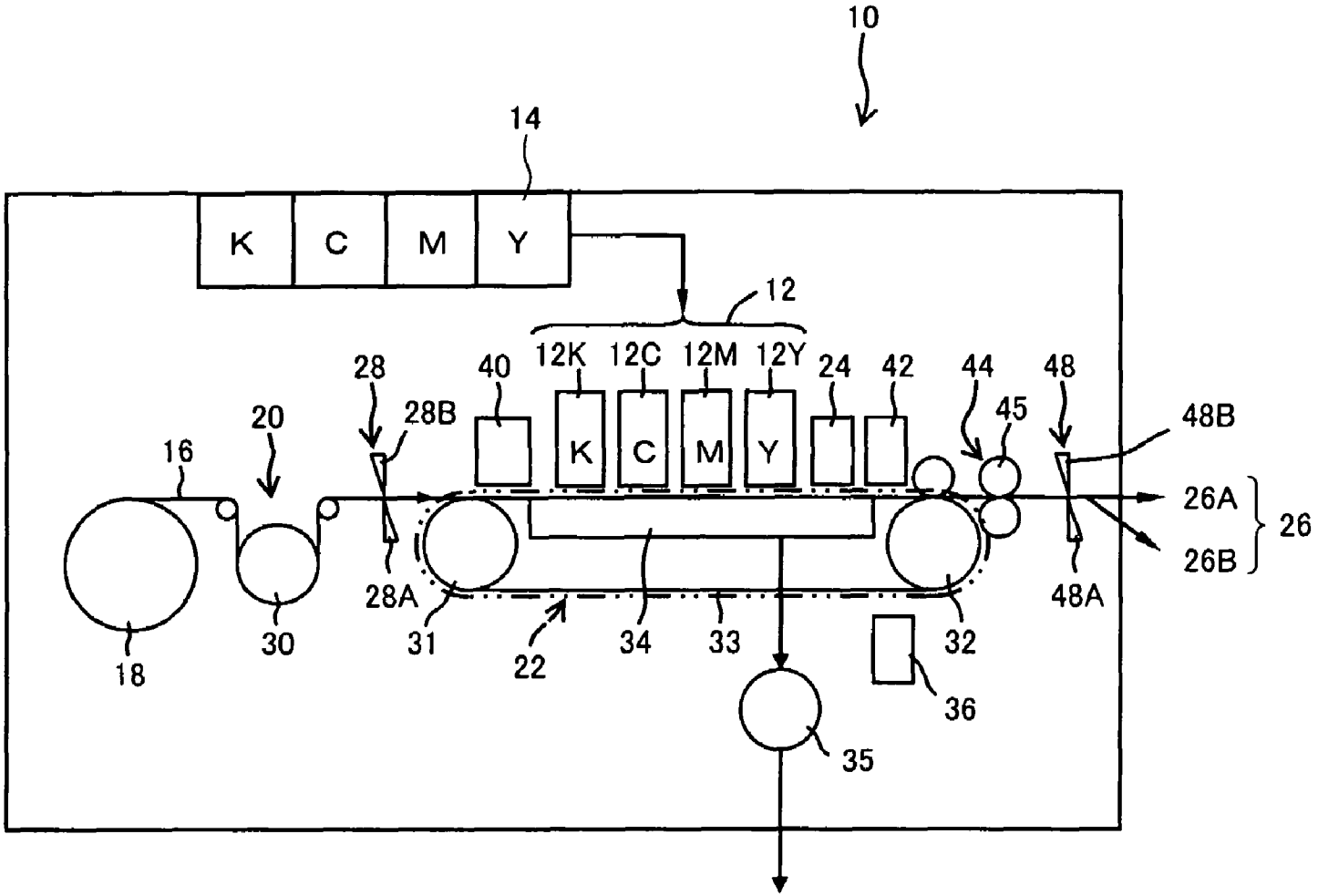
FIG. 1 is a general schematic drawing showing a general view of an inkjet recording apparatus according to an embodiment of the present invention.

FIG. 1 is a general schematic drawing of an inkjet recording apparatus forming an image recording apparatus according to an embodiment of the present invention. As shown in FIG. 1, an inkjet recording apparatus 10 includes: a print unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

There are no particular limitations on the structure of the belt conveyance unit 22, and it may use vacuum suction conveyance in which the recording paper 16 is conveyed by being suctioned onto the belt 33 by negative pressure created by suctioning air through suction holes provided on the belt surface, or it may be based on electrostatic attraction.

The belt 33 has a width dimension that is broader than the width of the recording paper 16, and in the case of the vacuum suction conveyance method described above, a plurality of suction holes (not illustrated) are formed on the surface of the belt. A suction chamber 34 is disposed in a position facing the sensor surface of the print determination unit 24 and the nozzle face of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 may include a roller nip conveyance mechanism, in which the recording paper 16 is pinched and conveyed with nip rollers, instead of the belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2:
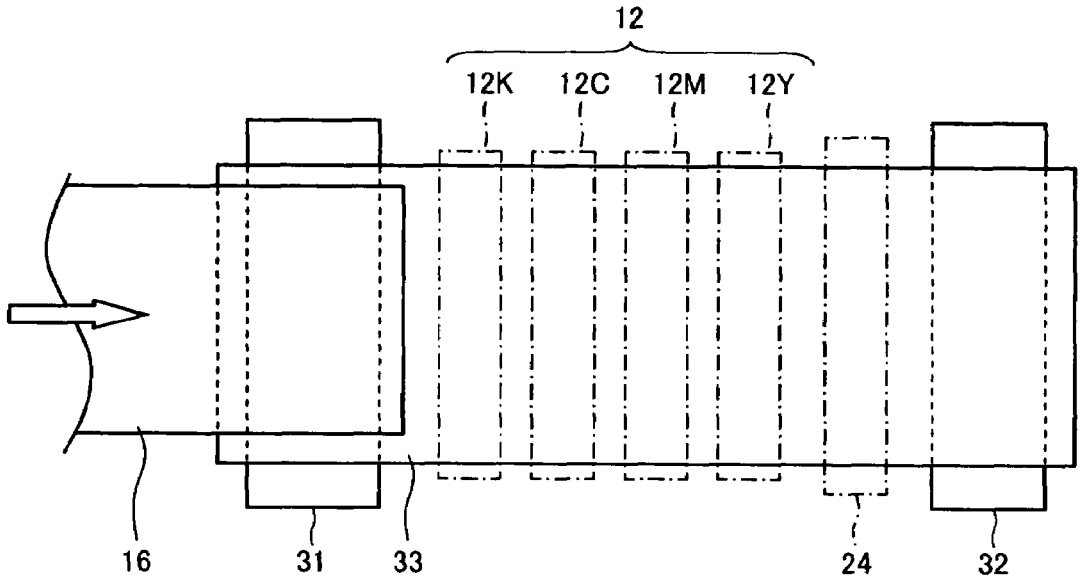
FIG. 2 is a principal plan diagram showing the peripheral area of a print unit of the inkjet recording apparatus.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction).

The print heads 12K, 12C, 12M and 12Y are constituted of line heads in which a plurality of ink ejection ports (nozzles) are arranged through a length exceeding at least one side of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, which is constituted of full-line heads covering the entire width of the paper provided respectively for the ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Here, the terms "main scanning direction" and "sub-scanning direction" are used in the following senses. More specifically, in a full-line head including rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which the sub-scanning is performed is called the sub-scanning direction. Consequently, the conveyance direction of the recording paper is the sub-scanning direction and the direction perpendicular to the conveyance direction is called the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor and the like) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated, the paper output unit 26A for the target prints is provided with a sorter for collecting prints according to print orders.

The print heads 12K, 12C, 12M and 12Y provided for the respective ink colors have the same structure, and a reference numeral 50 is hereinafter designated to a representative example of these print heads.

Figure 3:
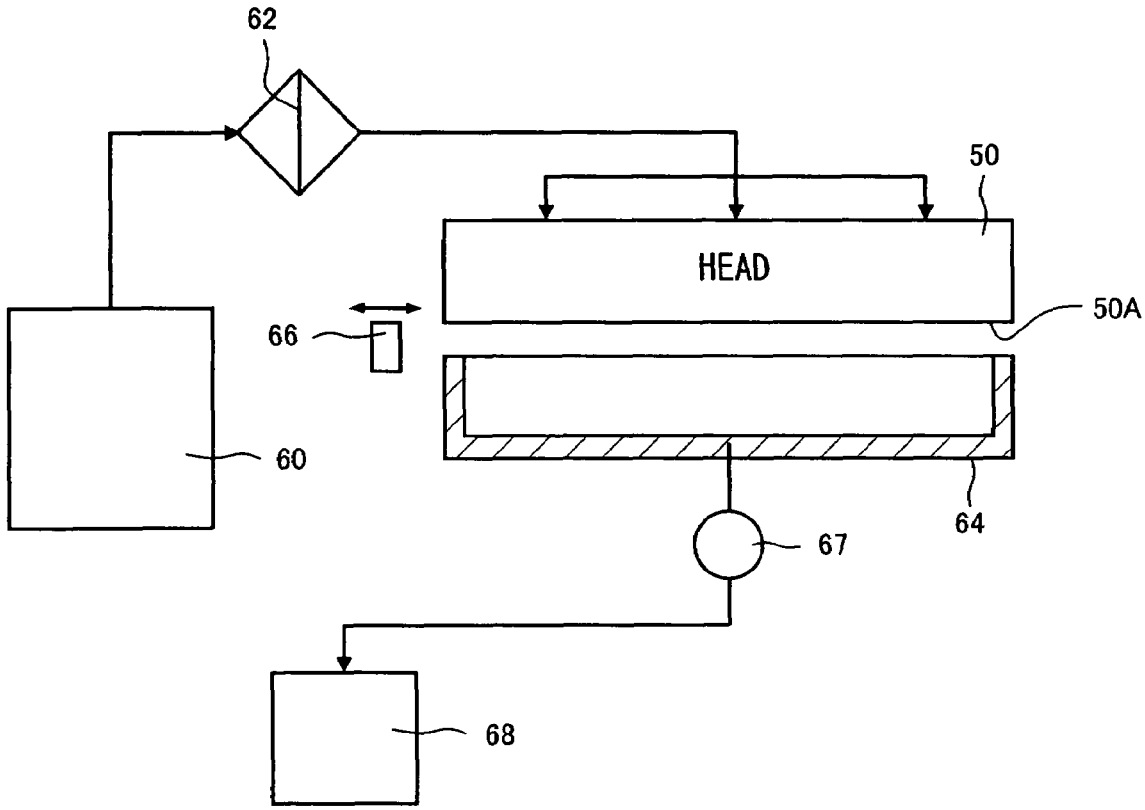
FIG. 3 is a schematic drawing showing an approximate view of an ink supply system in the inkjet recording apparatus.
Figure 7:
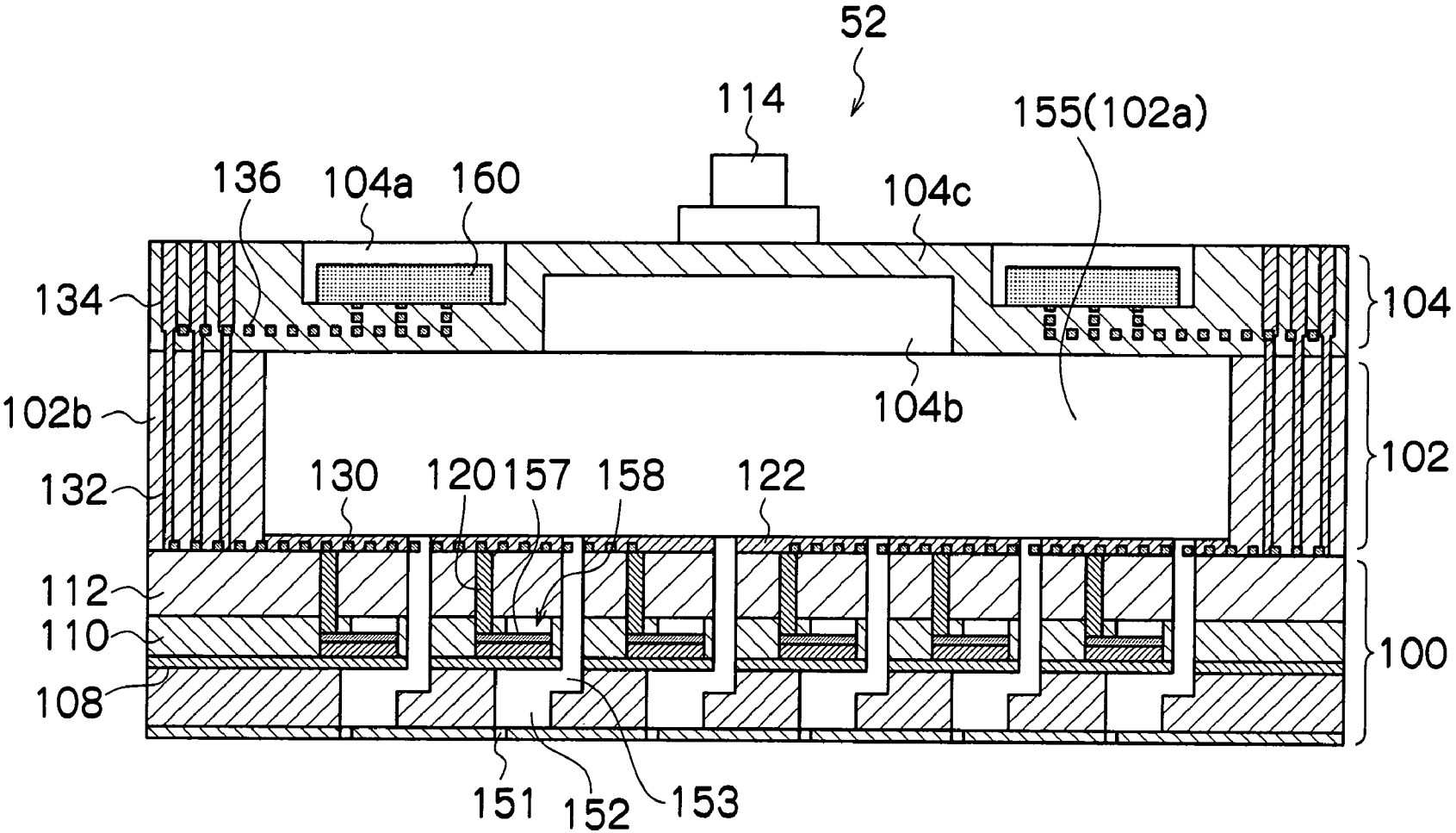
FIG. 7 is a cross-sectional diagram showing the basic general composition of the head unit.

FIG. 3 is a schematic drawing showing the configuration of the ink supply system in the inkjet recording apparatus 10. The composition of the print head 50 is described in detail hereinafter, but chiefly, a plurality of nozzles 151 for ejecting ink droplets are formed in the nozzle face 50A of the print head 50, pressure chambers 152 connected to the respective nozzles 151 are formed to the inner side of these, and piezoelectric elements 158 are provided on a diaphragm 156 which constitutes one wall defining the pressure chambers 152, at positions corresponding to the respective pressure chambers 152, as shown in FIG. 7. The ink inside the pressure chamber 152 is pressurized by the displacement of the corresponding piezoelectric element 158, and an ink droplet is ejected from the nozzle 151 connected to that pressure chamber 152.

As shown in FIG. 3, the ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 3 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 3. Preferably, the filter 62 has a filter mesh size equivalent to or less than the diameter of the nozzle of the print head 50 and commonly about 20 μm.

Although not shown in FIG. 3, it is preferable to provide a sub-tank integrally to the print head 50 or nearby the print head 50. The sub-tank has a damper function for preventing variation in the internal pressure of the head 50 and a function for improving refilling of the print head.

The inkjet recording apparatus 10 is also provided with a cap 64 as a device to prevent the nozzles 151 from drying out or to prevent an increase in the ink viscosity in the vicinity of the nozzles 151, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is moved upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to make tight contact with the print head 50, and the nozzle region of the nozzle face 50A is thereby covered by the cap 64.

The cleaning blade 66 is composed of rubber or another elastic member, and can slide on the ink ejection surface (the nozzle face 50A) of the print head 50 by means of a blade movement mechanism (not shown). When ink droplets or foreign matter has adhered to the nozzle face 50A, the nozzle face 50A is wiped and cleaned by sliding the cleaning blade 66 on the nozzle face 50A.

During printing or during standby, if the use frequency of a particular nozzle 151 has declined and the ink viscosity in the vicinity of the nozzle 151 has increased, then a preliminary ejection is performed toward the cap 64, in order to remove the ink that has degraded as a result of increasing in viscosity.

Moreover, when bubbles have become intermixed into the ink inside the print head 50 (the ink inside the pressure chambers 152), the cap 64 is placed on the print head 50, ink (ink in which bubbles have become intermixed) inside the pressure chambers 152 is removed by suction with a suction pump 67, and the ink removed by suction is sent to a recovery tank 68. This suction operation is also carried out in order to suction and remove degraded ink which has hardened due to increasing in viscosity when ink is loaded into the print head for the first time, and when the print head starts to be used after having been out of use for a long period of time.

More specifically, when a state in which ink is not ejected from the print head 50 continues for a certain amount of time or longer, the ink solvent in the vicinity of the nozzles evaporates and ink viscosity increases. In such a state, ink can no longer be ejected from the nozzle even if the actuator (piezoelectric element 158) for the ejection driving is operated. Before reaching such a state (in a viscosity range that allows ejection by the operation of the piezoelectric element 158) the piezoelectric element 158 is operated to perform the preliminary discharge to eject the ink whose viscosity has increased in the vicinity of the nozzle, toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles by the wiper sliding operation. The preliminary discharge is also referred to as "dummy discharge", "purge", "liquid discharge", and so on.

When bubbles have become intermixed in the nozzle 151 or the pressure chamber 152, or when the ink viscosity inside the nozzle 151 has increased over a certain level, ink can no longer be ejected by the preliminary discharge, and a suctioning action is carried out as follows.

More specifically, when bubbles have become intermixed into the ink inside the nozzles 151 and the pressure chambers 152, or when the viscosity of the ink inside the nozzle 151 has increased to a certain level or more, ink can no longer be ejected from the nozzles 151 even if the piezoelectric elements 158 are operated. In a case of this kind, the cap 64 is placed on the nozzle face 50A of the print head 50, and the ink containing bubbles or the ink of increased viscosity inside the pressure chambers 152 is suctioned by a pump 67.

However, since this suction action is performed with respect to all the ink in the pressure chambers 152, the amount of ink consumption is considerable. Therefore, a preferred aspect is one in which a preliminary discharge is performed when the increase in the viscosity of the ink is small. The cap 64 shown in FIG. 3 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 4:
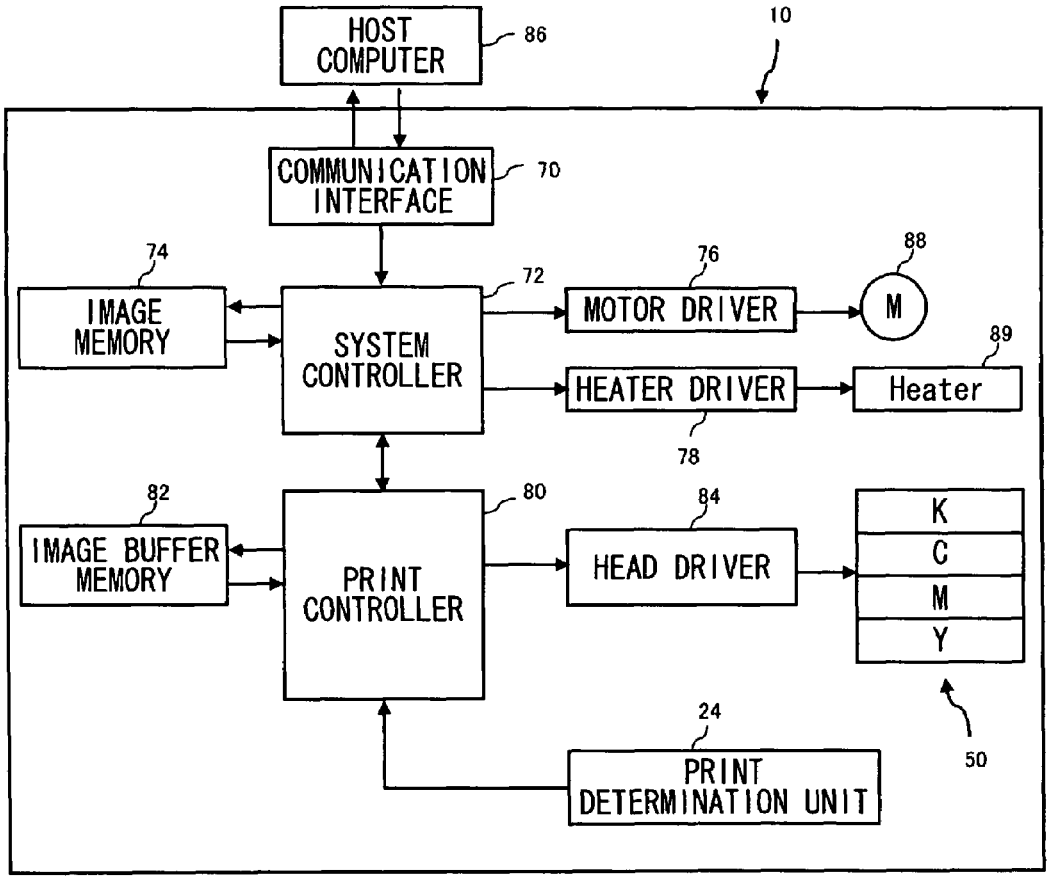
FIG. 4 is a block diagram showing a system composition of the inkjet recording apparatus.

FIG. 4 is a principal block diagram showing the system configuration of the inkjet recording apparatus 10. The inkjet recording apparatus 10 includes a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet (registered trademark), wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communication interface 70, the image memory 74, the motor driver 76, the heater driver 78, and the like. The system controller 72 is constituted of a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver (drive circuit) 84. Prescribed signal processing is carried out in the print controller 80, and the ejection amount and the ejection timing of the ink droplets from the respective print heads 50 are controlled via the head driver 84, on the basis of the print data. By this means, desired dot size and dot positions can be achieved.

The print controller 80 is accompanied by the image buffer memory 82; and image data, parameters, and other data are temporarily stored in the image buffer memory 82 when image data is processed in the print controller 80. The aspect shown in FIG. 4 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric element 158 of the print heads 50 of the respective colors on the basis of the print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the print head 50 on the basis of information obtained from the print determination unit 24.

Next, the composition of the print head 50 according to an embodiment of the present invention is described.

Figure 5:
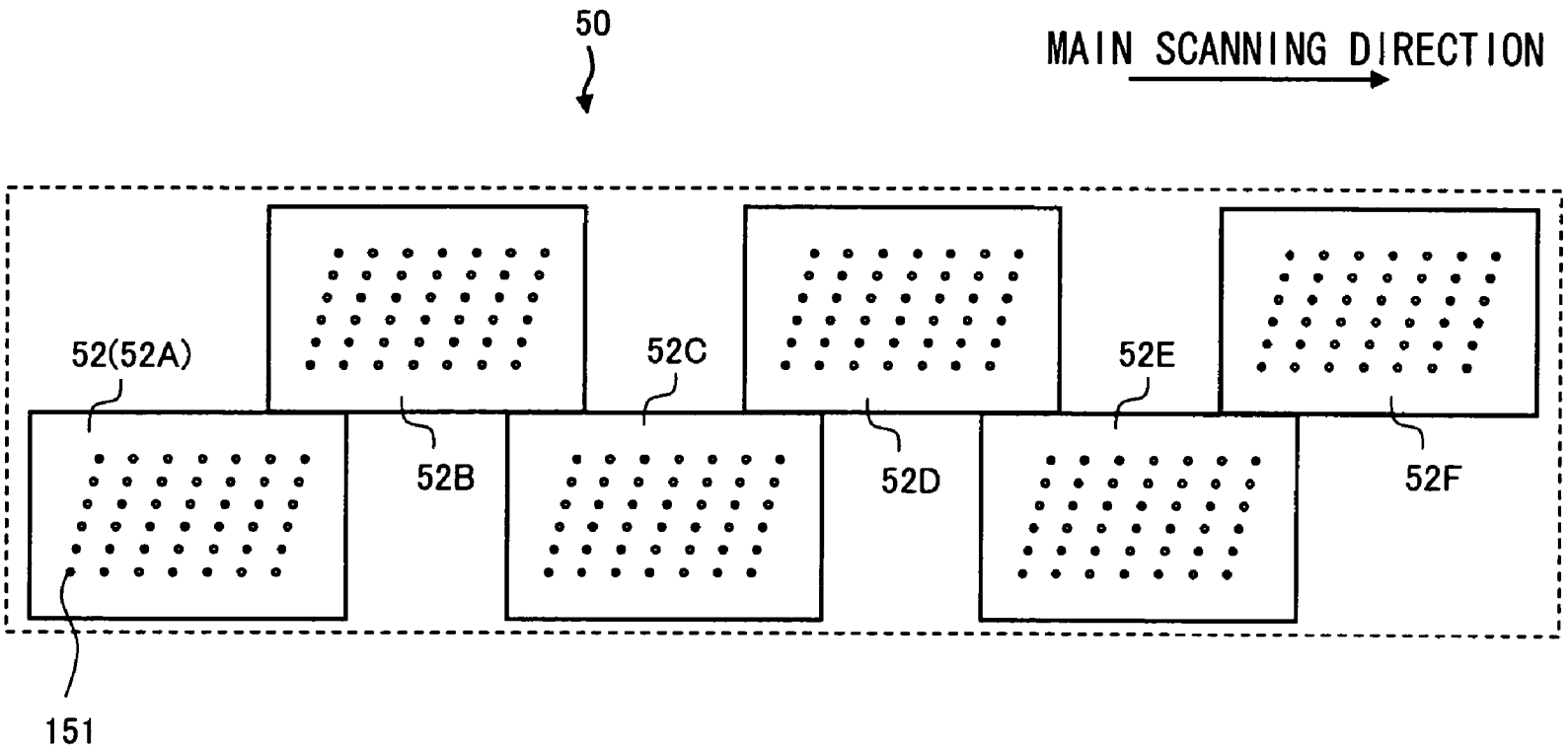
FIG. 5 is a plan view showing a nozzle face of a print head according to an embodiment of the present invention.

FIG. 5 is a plan diagram showing the nozzle face of the print head 50 according to an embodiment of the present invention. As shown in FIG. 5, the print head 50 is constituted of a full line head which is formed to a long length by disposing a plurality of short head units 52 (52A to 52F) in a staggered arrangement in the main scanning direction. A plurality of nozzles 151 for ejecting ink droplets are formed in each of the head units 52. The nozzles 151 are arranged in a two-dimensional (matrix) configuration, following a main scanning direction and an oblique direction which is not perpendicular to the main scanning direction, and hence a uniform and small nozzle pitch is achieved in the project nozzle row obtained by projecting the nozzles 151 to an alignment in the main scanning direction.

The basic general composition of the head unit 52 of this kind is described below, and next, the details of this composition are explained.

Figure 6:
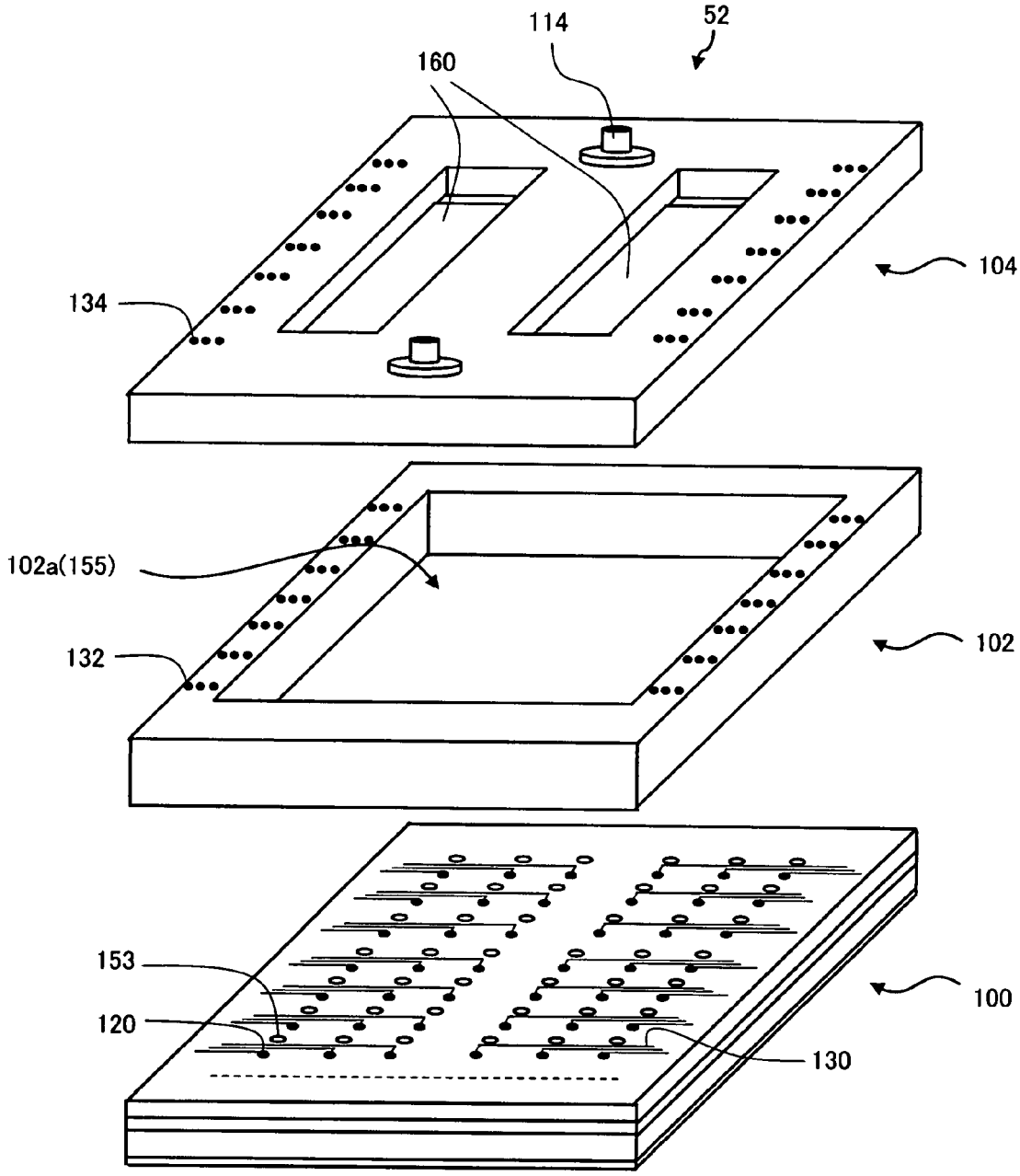
FIG. 6 is an exploded perspective diagram showing the basic general composition of a head unit according to an embodiment of the present invention.

FIGS. 6 and 7 are diagrams showing the basic general composition of the head unit 52. FIG. 6 is an exploded perspective diagram, and FIG. 7 is a cross-sectional diagram. As shown in FIGS. 6 and 7, the head unit 52 is formed by bonding together: a liquid ejection unit 100 including the nozzles 151, the pressure chambers 152 and the piezoelectric elements 158, and the like; a frame substrate 102 in which a hole section 102*a* corresponding to the common liquid chamber 155 is formed passing through the frame substrate 102; and a selection circuit board 104 (corresponding to the "cover plate" used for the present invention) on which selection circuits 160 corresponding to switch ICs (SWICs) are mounted. The common liquid chamber 155 for accumulating the ink is defined by these members (the liquid ejection unit 100, the frame substrate 102 and the selection circuit board 104). In other words, the lower wall, the lateral walls and the upper wall defining the common liquid chamber 155 are constituted of the liquid ejection unit 100, the frame substrate 102 and the selection circuit board 104, respectively.

The plurality of nozzles 151 and the plurality of pressure chambers 152 corresponding to these nozzles 151 are formed in the liquid ejection unit 100. Each pressure chamber 152 is connected to the nozzle 151 corresponding to the pressure chamber 152, and the ink to be ejected from the nozzle 151 is filled in the pressure chamber 152.

Furthermore, supply flow channels 153 corresponding to the pressure chambers 152 are also formed in the liquid ejection unit 100, and one open end of each supply flow channel 153 is connected to the corresponding pressure chamber 152, while the other open end of the supply flow channel 153 is connected to the upper side of the liquid ejection unit 100. In other words, each of the pressure chambers 152 is connected to the common liquid chamber 155 via the corresponding supply flow channel 153, and the ink in the common liquid chamber 155 is distributed and supplied to the pressure chambers 152.

One wall (the upper wall, in FIG. 7) of each of the pressure chambers 152 is constituted of a diaphragm 108. The piezoelectric elements 158 are arranged on the diaphragm 108 at positions corresponding to the pressure chambers 152, in other words, each of the piezoelectric elements 158 is arranged across the diaphragm 108 from the corresponding pressure chamber 152. An individual electrode 157 is formed on the upper surface of each of the piezoelectric elements 158. In the present embodiment, the diaphragm 108 also serves as a common electrode for the piezoelectric elements 158.

Through electrodes 120 corresponding to the piezoelectric elements 158 are formed in a spacer plate 110 and ceiling plate 112, which are disposed on the diaphragm 108 to form a protective member for the piezoelectric elements 158. The lower ends of the through electrodes 120 are electrically connected to the individual electrodes 157 of the corresponding piezoelectric elements 158, and the upper ends of the through electrodes 120 are exposed at the surface of the ceiling plate 112 (on the side of the frame substrate 102). Electrical wires 130 are formed on the surface of the ceiling plate 112, and the electrical wires 130 extend from the exposed portions of the through electrodes 120 toward an end portion of the ceiling plate 112 at which the lateral wall 102*b* of the frame substrate 102 is bonded. In order to prevent the exposed portions of the through electrodes 120 and the electrical wires 130 from coming into contact with the ink in the common liquid chamber 155, an insulating protective film 122 (for example, a resin film) is formed over the exposed portions of the through electrodes 120 and the electrical wires 130 on the surface (the upper surface of the ceiling plate 112) of the liquid ejection unit 100 which surface constitutes an inner face of the common liquid chamber 155.

The hole section 102*a* corresponding to the common liquid chamber 155 is formed to pass through the frame substrate 102, and a plurality of through holes 132 are formed in the lateral wall 102*b* of the frame substrate 102. These through holes 132 are formed to pass through the lateral wall 102*b* and are exposed at the upper and lower end surfaces of the lateral wall 102*b*, and the interiors (or the internal walls) of the through holes 132 are made to be electrically conductive (below, the conductive through holes 132 are also referred to as "through electrodes 132"). The through electrodes 132 are electrically connected respectively to the electrical wires 130, which are formed on the exposed surface of the ceiling plate 112.

A plurality of connection holes 134 are formed passing through the selection circuit board 104. Each connection hole 134 is formed to have a larger diameter on the upper side thereof and to have a smaller diameter on the lower side thereof, and the diameter of the connection hole 134 changes from the larger diameter to the smaller diameter at the intermediate point of the connection hole 134. In other words the connection holes 134 are formed in a counterbored shape. The interiors of the connection holes 134 are made to be electrically conductive (hereinafter, these electrically conductive connection holes 134 are also referred to as "connection electrodes 134"). The connection electrodes 134 are exposed on the side of the frame substrate 102, and these exposed portions of the connection electrodes 134 are electrically connected respectively to the through electrodes 132 formed in the lateral wall 102*b* of the frame substrate 102.

Figure 8A:
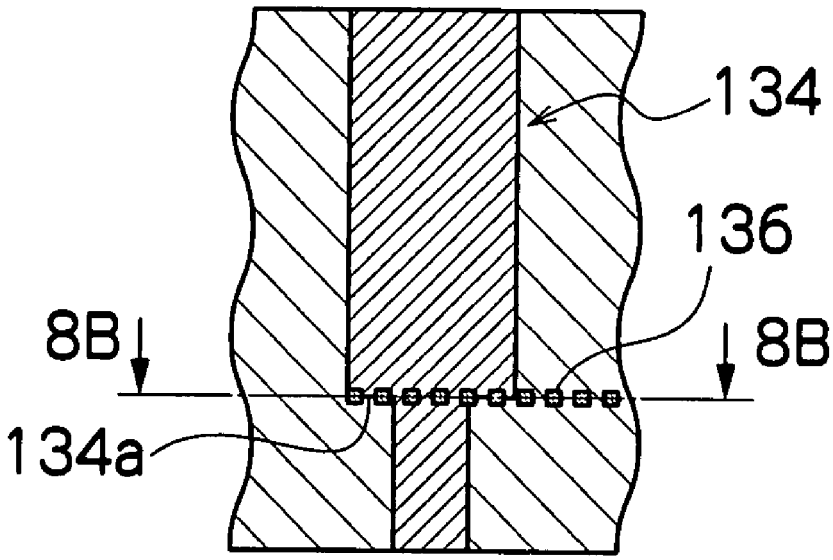
FIGS. 8A and 8B are enlarged cross-sectional diagrams of connection electrodes.
Figure 8B:
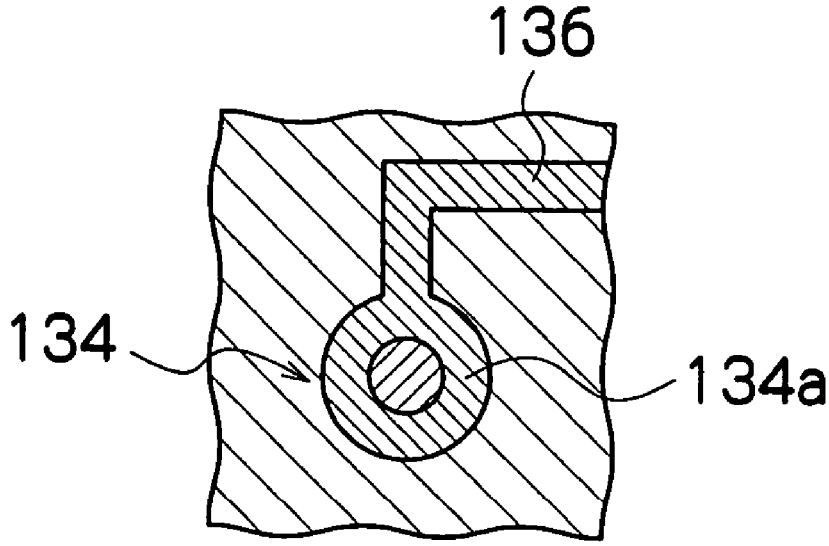

FIG. 8A is an enlarged cross-sectional diagram of the connection electrode 134, and FIG. 8B is a cross-sectional diagram along line 8B-8B in FIG. 8A. As shown in FIGS. 8A and 8B, electrical wires 136 are formed inside the selection circuit board 104, and each electrical wire 136 has one end at which the electrical wire 136 is connected to a land section (step section) 134*a* of the connection electrode (the electrically conductive connection hole) 134. The other end of each electrical wire 136 is electrically connected to the output side of the selection circuit 160, as shown in FIG. 7.

As shown in FIG. 7, the selection circuit board 104 is formed with groove sections 104*a* on the side reverse to the side adjacent the frame substrate 102 (namely, on the side reverse to the side adjacent to the common liquid chamber 155), and the selection circuits 160 are disposed respectively on the lower faces of the groove sections 104*a*. FIG. 7 shows an example in which two selection circuits 160 are disposed respectively in different groove sections 104*a*. In the present embodiment, the selection circuits 160 are switch ICs (SWICs), which have a function for selecting the piezoelectric elements 158 to be applied with drive signals generated by the drive circuit 84.

A connector for external wiring connection (not illustrated) is arranged on the input side of the selection circuit 160, at a desired position on the selection circuit board 104. The drive signal generated by the drive circuit 84 (shown in FIG. 4) is input to the selection circuit 160 via the external wiring, such as a flexible cable, connected to this connector.

The selection circuit board 104 is formed with a groove section 104*b* in approximately the central portion (between the two groove sections 104*a*) on the side adjacent to the common liquid chamber 155. A thin section 104*c* of the selection circuit board 104 in the position corresponding to this groove section 104*b* functions as a damper which deadens pressure variations in the common liquid chamber 155. Accordingly, it is possible to suppress the effects of cross-talk through the fluid during ink ejection.

An ink supply port 114 is provided for the selection circuit board 104 to supply ink from the ink tank 60 (shown in FIG. 3) to the common liquid chamber 155 through a tubing channel (not illustrated) which is connected to the ink supply port 114. Consequently, it is not necessary to integrate the ink tank 60 into the head unit 52, and hence the print head 50 can be made compact in size.

By means of this composition, when one of the piezoelectric elements 158 to be supplied with the drive signal from the drive circuit 84 is selected by the selection circuit 160, then the drive signal is supplied to the individual electrode 157 of the selected piezoelectric element 158, via the prescribed connection electrode 134 and the through electrodes 132 and 120. Therefore, the piezoelectric element 158 is displaced in accordance with the drive signal, and due to the deformation of the diaphragm 156 caused by this displacement, the ink filled in the pressure chamber 152 is pressurized and an ink droplet is ejected from the nozzle 151 connected to this pressure chamber 152. After ejecting ink, when the supply of the drive signal is halted, then the piezoelectric element 158 reverts to its original state, and new ink is accordingly supplied to the pressure chamber 152 from the common liquid chamber 155, via the supply flow channel 153.

Next, the detailed composition of the head unit 52 is described.

Figure 9:
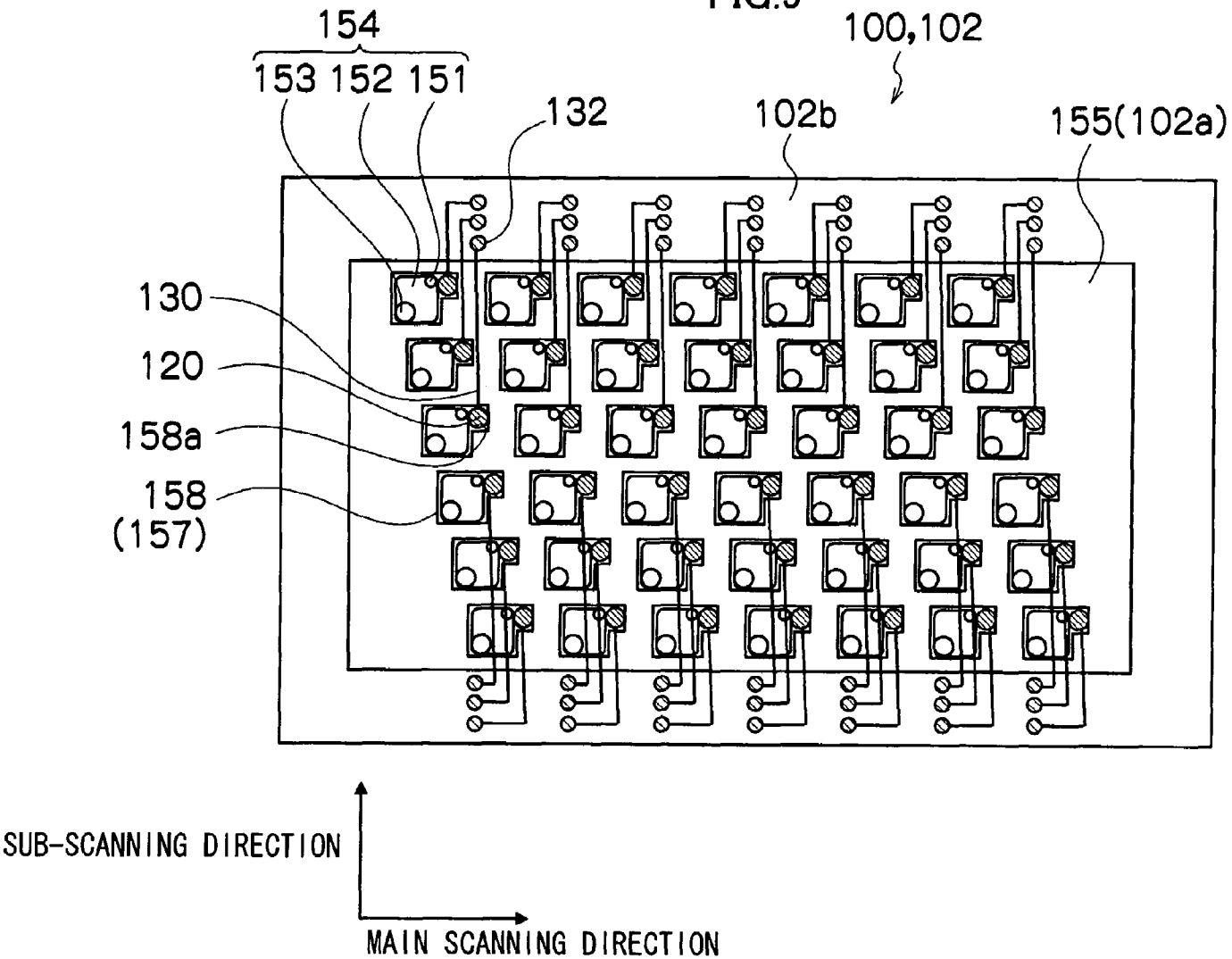
FIG. 9 is a plan view perspective diagram showing a state where a frame substrate is stacked on a liquid ejection unit.

FIG. 9 is a plan view perspective diagram showing a state where the frame substrate 102 is superimposed on the liquid ejection unit 100, and FIG. 9 shows a view as observed from the side of the frame substrate 102. As shown in FIG. 9, each pressure chamber 152 has a planer shape of approximately square, and the nozzle 151 and the supply flow channel 153 are disposed respectively at opposing corner sections of each pressure chamber 152. Each pressure chamber unit 154 includes these elements (the pressure chamber 152, nozzle 151 and the supply flow channel 153), and the pressure chamber units 154 are arranged at high density in a two-dimensional configuration (matrix arrangement).

The piezoelectric elements 158 are disposed in positions such that the piezoelectric elements 158 approximately overlap the corresponding pressure chambers 152, and each piezoelectric element 158 has a projecting section 158*a* that is formed integrally on one end thereof. This projecting section 158*a* is disposed in a position outside the pressure chamber 152, in other words, in a position corresponding to a wall (a pressure chamber wall) defining the pressure chamber 152.

Each of the through electrodes 120 is disposed in a position such that the through electrode 120 overlaps the projecting section 158*a* of the corresponding piezoelectric element 158, and is electrically connected to the individual electrode 157 formed on the upper surface of the corresponding piezoelectric element 158.

Each of the electrical wires 130 extends from the through electrode 120 toward the end portion on which the lateral wall 102*b* of the frame substrate 102 is bonded. Each electrical wire 130 has an end that is electrically connected to the through electrode 120 and the other end that is electrically connected to the through electrode 132, which passes the lateral wall 102*b* of the frame substrate 102 along the direction of the obverse-reverse of the sheet containing FIG. 9. The electrical wires 130 are arranged in such a manner that no one of the electrical wires 130 overlaps with the other electrical wires 130 or with the through electrodes 120 that are connected to the other electrical wires 130.

The actual locations of the nozzles 151, the supply flow channels 153, and the piezoelectric elements 158 corresponding to the pressure chambers 152, the through electrodes 120, and the like are as shown in FIG. 9, although they have been depicted in FIG. 7 as being located in the same cross-sectional plane in order to aid understanding of the general composition of the head unit 52.

Figure 10A:
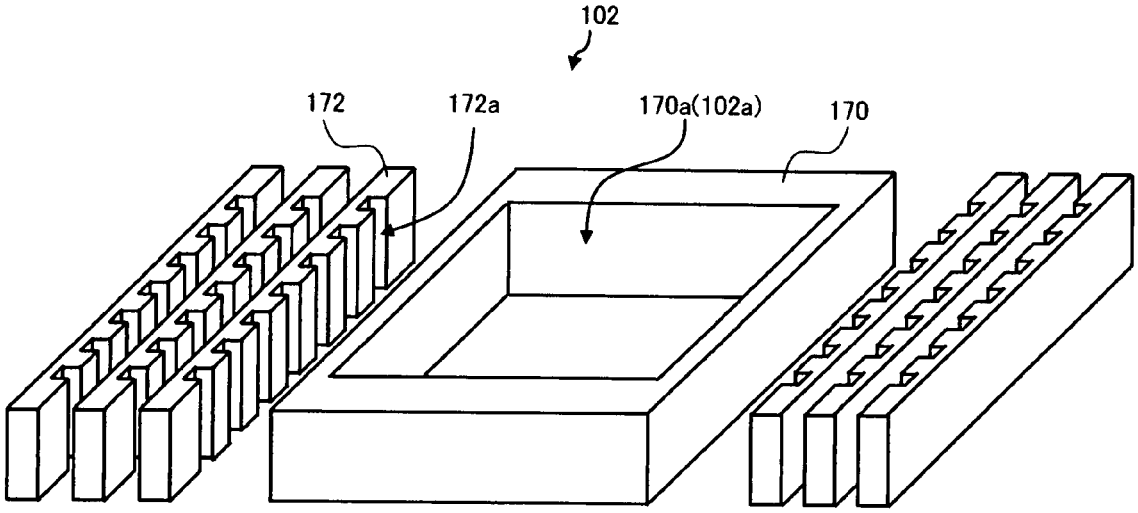
FIGS. 10A and 10B are schematic drawings of a frame substrate according to an embodiment of the present invention.
Figure 10B:
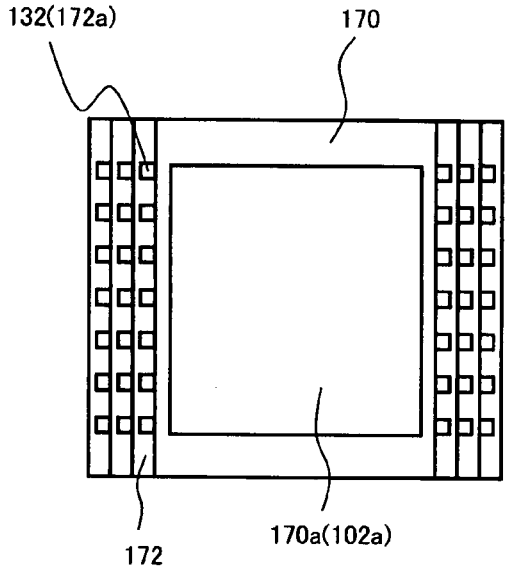

FIGS. 10A and 10B are schematic drawings of the frame substrate 102. FIG. 10A is an exploded perspective diagram and FIG. 10B is a plan diagram. As shown in FIGS. 10A and 10B, the frame substrate 102 is principally constituted of a frame member 170 formed with a hole section 170*a* (the hole section 102*a*) corresponding to the common liquid chamber 155 passing through the frame member 170, and wall members 172 each formed with a plurality of groove sections 172*a*. The wall members 172 are oriented in a prescribed direction and are then stacked and bonded on two opposing lateral faces of the frame member 170. The groove sections 172*a* have a long, thin shape, and are open at the opposing end faces of the wall member 172. These groove sections 172*a* correspond to the through holes 132 formed in the lateral walls 102*b* of the frame substrate 102. Consequently, it is possible to form the through holes 132 having a high aspect ratio in the lateral walls 102*b* of the frame substrate 102. To give an example of the dimensions of the through hole 132 formed in this manner, in FIG. 10B, the width of the through hole 132 is approximately 0.1 mm, and the depth of the through hole 132 is approximately 1 mm to 5 mm.

By manufacturing the frame member 170 and the wall members 172 by die molding or resin molding, it is possible to achieve inexpensive mass production of these elements. Moreover, by manufacturing the wall members 172 by means of nano-imprinting or the like, then as well as being able to achieve inexpensive mass production, it is also possible to form the plurality of very fine groove sections 172*a* at high density.

It is desirable that the upper and lower end faces (namely, the end faces perpendicular to the direction of stacking of the wall members 172) of the frame substrate 102 constituted of the frame member 170 and the wall members 172 are formed to a planar shape by removing any undulations by grinding (polishing). It is thereby possible to improve the reliability of bonding with the liquid ejection unit 100 and the selection circuit board 104.

FIGS. 10A and 10B show embodiments in which the frame substrate 102 is constituted of the wall members 172 formed in such a manner that all of the groove sections 172*a* are opened on the same side (the side facing toward the frame member 170), but the composition of the frame substrate 102 is not limited to this in carrying out the present invention.

Figure 11A:
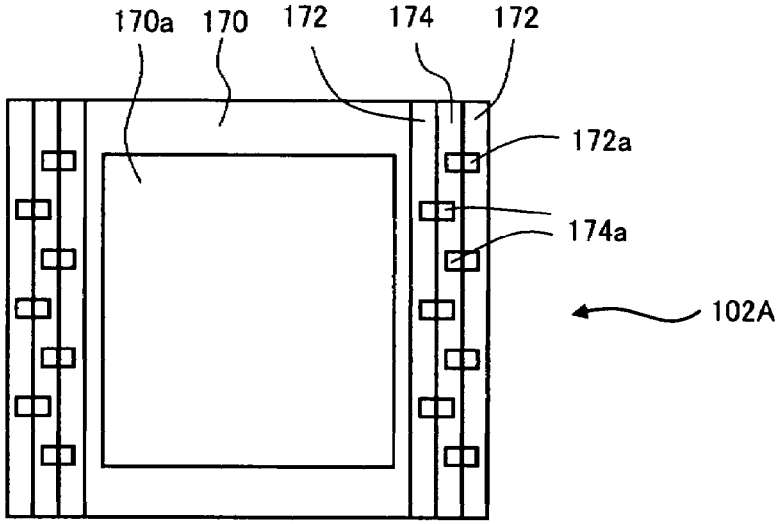
FIGS. 11A to 11C are plan diagrams showing a frame substrate according to modified embodiments of the present invention.
Figure 11B:
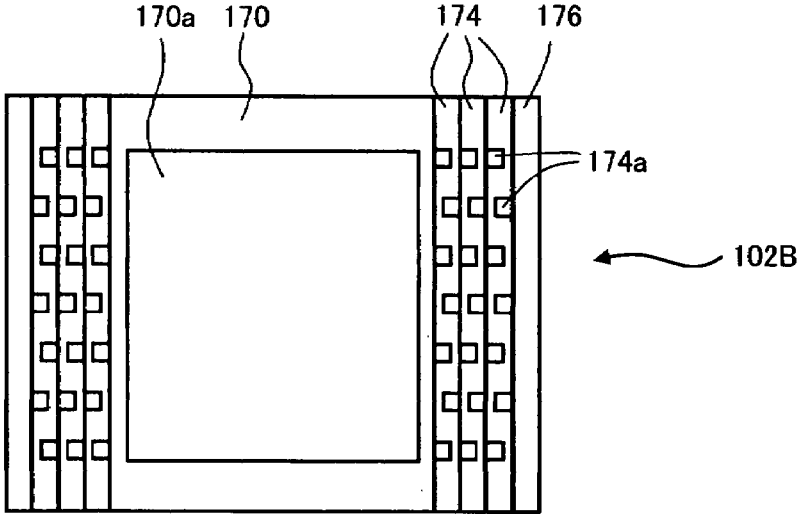
Figure 11C:
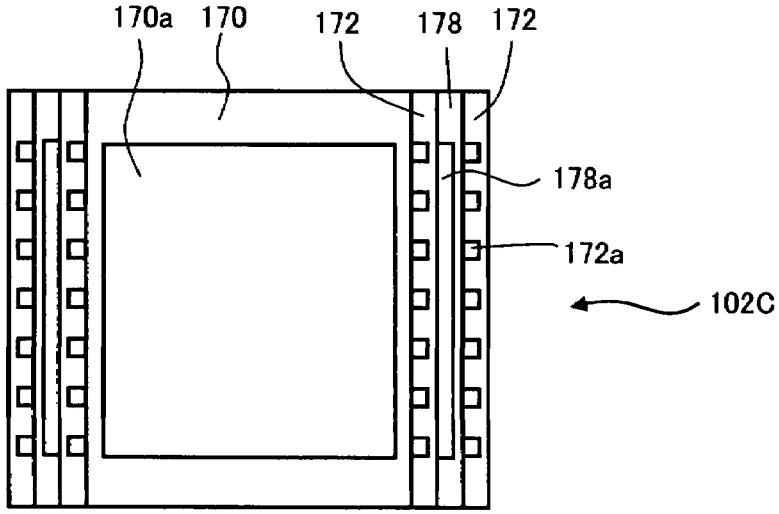

FIGS. 11A to 11C are plan diagrams showing modified embodiments of the frame substrate 102.

A frame substrate 102A shown in FIG. 11A is constituted of the wall members 174 that have the groove sections 174*a* of alternately changing positions between opposite sides. By uniformly arranging the groove sections 174*a* in a staggered fashion, it is possible to prevent warp of the wall members 174. Moreover, in the frame substrate 102A, the groove sections 174*a* in the wall member 174 are arranged to face to the groove sections 172*a* in the adjacent wall member 172 (in other words, the groove sections 174*a* and the corresponding groove sections 172*a* are united into large grooves). In this way, the cross-sectional area of the through electrodes formed of the mutually opposite groove sections 174*a* and 172*a* is increased, and hence the reliability of the electrical connections is improved.

A frame substrate 102B shown in FIG. 11B is constituted of the wall members 174 that have the groove sections 174*a* not facing to the groove sections 174*a* of the adjacent wall members 174. By adopting a composition of this kind, it is possible to form a large number of through electrodes to a high density. Planar-shaped wall members 176 are disposed on lateral faces of the frame substrate 102, and the planer-shaped wall members 176 seal the groove sections 174*a* in the wall members 174 disposed on the inner side of the planer-shaped wall members 176.

A frame substrate 102C shown in FIG. 11C includes wall members 178 formed with groove sections 178*a* having a large width. The through electrode formed in the wide groove section 178*a* can serve as ground wiring. As shown in FIG. 11C, by interposing the wall member 178 between the wall members 172 that are adjacent thereto, it is possible to prevent electrical cross-talk occurring between the adjacent wall members 172.

Figure 12A:
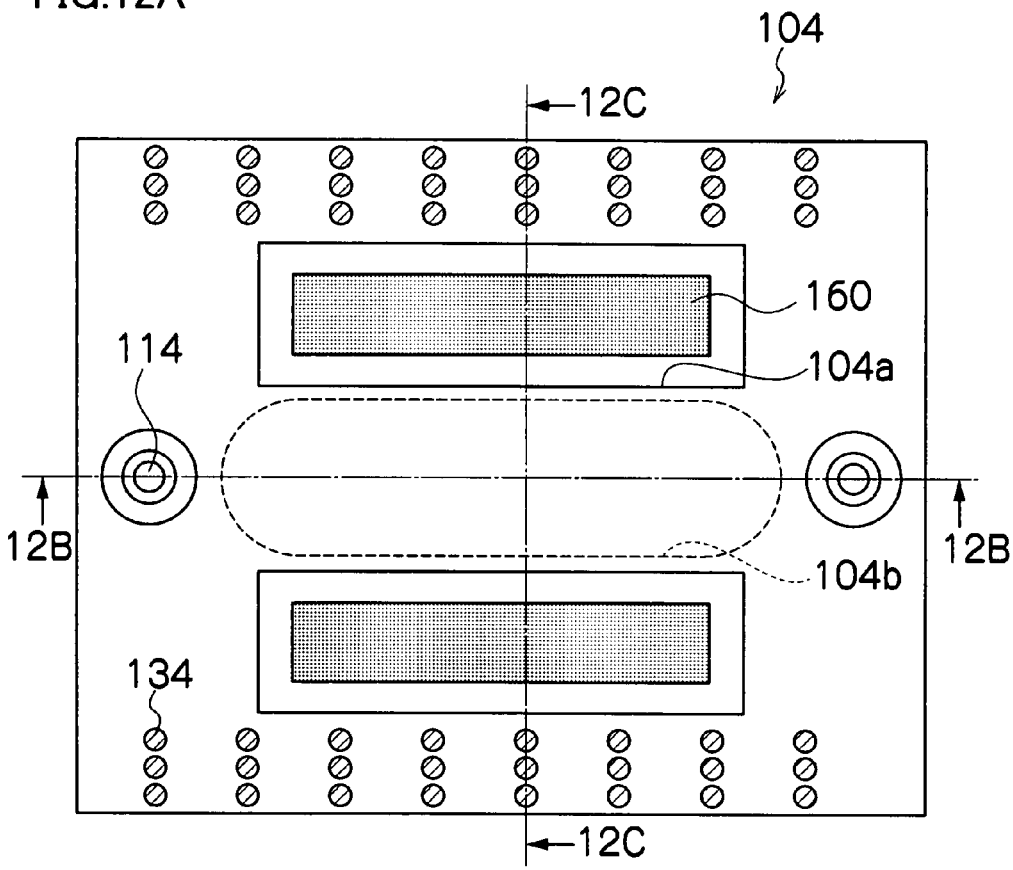
FIGS. 12A to 12C are schematic drawings of a selection circuit board according to an embodiment of the present invention.
Figure 12B:
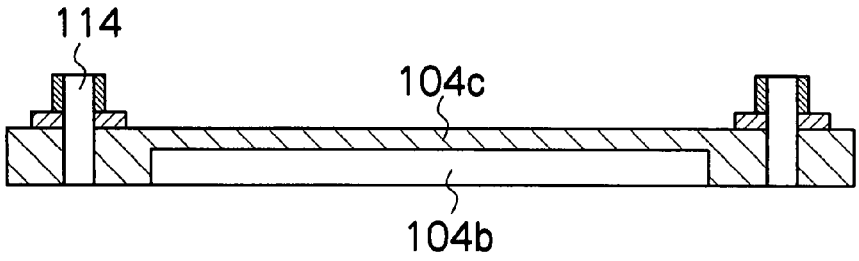
Figure 12C:
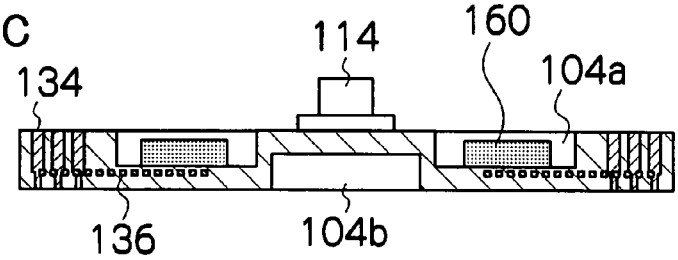

FIGS. 12A to 12C are schematic drawings showing the selection circuit board 104 constituted of a laminated substrate. FIG. 12A is a plan diagram, FIG. 12B is a cross-sectional diagram along line 12B-12B in FIG. 12A, and FIG. 12C is a cross-sectional diagram along line 12C-12C in FIG. 12A. As shown in FIGS. 12A to 12C, the two groove sections 104*a* having a prescribed opening area are formed in the selection circuit board 104, and the groove section 104*b* is formed on the side of the selection circuit board 104 reverse to the side on which the groove sections 104*a* are formed. The selection circuits 160 are each disposed on the bottom faces of the groove sections 104*a*. Moreover, the thin section 104*c* at the position corresponding to the groove section 104*b* functions as the damper which deadens the pressure variation in the common liquid chamber 155.

The two ink supply ports 114 for supplying ink to the common liquid chamber 155 are provided for the selection circuit board 104, and ink can therefore be supplied to the common liquid chamber 155 via these ink supply ports 114.

The plurality of connection holes 134 are formed in the selection circuit board 104. Each of the connection holes 134 has a larger diameter on the upper side thereof and has a smaller diameter on the lower side thereof, and the diameter of the connection hole 134 changes from the larger diameter to the smaller diameter at the intermediate point of the connection hole 134. In other words, the connection holes 134 are formed in a counterbored shape. The interiors (or the inner wall surfaces) of the connection holes 134 are made to be electrically conductive. These electrically conductive connection holes (connection electrodes) 134 are exposed at the portions of the selection circuit board 104 to which the lateral wall 102*b* of the frame substrate 102 is bonded, and these exposed portions of the connection electrodes 134 are electrically connected to the through electrodes 132 formed in the lateral wall 102*b* of the frame substrate 102.

The plurality of electrical wires 136 are formed inside the selection circuit board 104, and each of the electrical wires 136 has an end that is electrically connected to the land section (step section) 134*a* of the connection electrode 134 (as shown in FIGS. 8A and 8B), and the other end that is electrically connected to the output side of the selection circuit 160.

As the material constituting the selection circuit board 104 and the frame substrate 102 described above, it is possible to use a material such as an epoxy resin, which has excellent chemical resistance and high tolerance to ink. Moreover, it is also possible to use a material that has poor liquid resistance properties, by covering with a protective film.

In the present embodiment, the common liquid chamber 155 is defined by the liquid ejection unit 100, the frame substrate 102 and the selection circuit board 104. Since the common liquid chamber 155 thus has a relatively large capacity, then it is possible to readily suppress the effects of pressure waves propagating in the common liquid chamber 155 due to ink ejection.

Moreover, in the present embodiment, since the selection circuit board 104 constituting the upper wall defining the common liquid chamber 155 has the thin section 104*c* functioning as a damper for deadening the effects of pressure waves, then it is possible to suppress the effects of fluid cross-talk, more reliably.

Moreover, in the present embodiment, since the upper wall defining the common liquid chamber 155 is constituted of the selection circuit board 104, then a structure with good thermal radiation characteristics is obtained, in which it is possible to efficiently transfer heat generated from the selection circuits 160 mounted on the selection circuit board 104 to the ink in the common liquid chamber 155, and it is also thereby possible to suppress any increase in the viscosity of the ink, and therefore high-viscosity ink can be ejected in a stable fashion.

Further, in the present embodiment, since the selection circuits 160 are mounted on the selection circuit board 104, it is then possible to connect the print head 50 with the drive circuit 84 through low-density wiring, thereby enabling reductions in the size and cost of the print head 50.

Furthermore, in the present embodiment, since the selection circuit board 104 has a plurality of functions as described above, it is then possible to reduce the number of components used in the head unit 52 and to thereby reduce the cost and size of the print head 50 including the head units 52.

Next, a method of manufacturing the print head 50 constituted of the above-described head units 52, is described below.

Figure 13A:
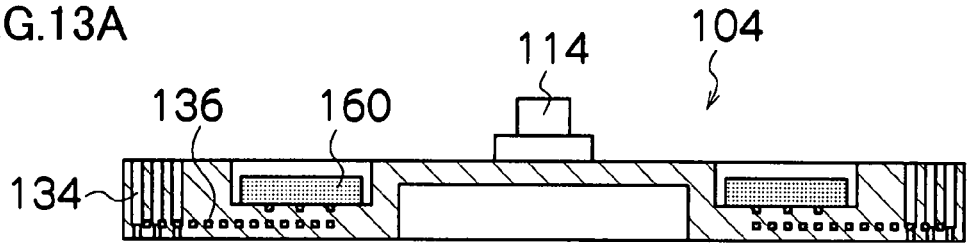
FIGS. 13A to 13D are process diagrams showing a method of manufacturing the head unit, according to an embodiment of the present invention.
Figure 13B:
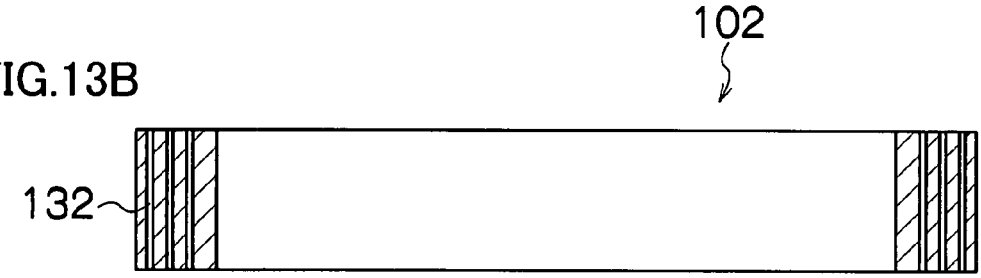
Figure 13C:
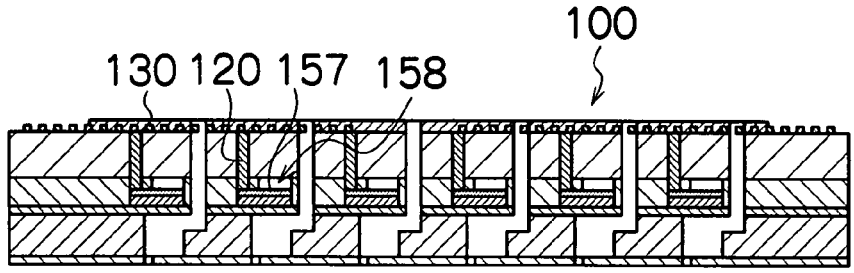

Firstly, as shown in FIGS. 13A to 13C, the constituent members of the head unit 52, in other words, the selection circuit board 104, the frame substrate 102 and the liquid ejection unit 100, are manufactured individually. In manufacturing the frame substrate 102, the frame member 170 and the wall members 172 are manufactured by die molding or resin molding as shown in FIGS. 10A and 10B, whereupon the wall members 172 are stacked and bonded to either side of the frame member 170, by means of adhesive, fusion, or the like. After bonding the wall members 172, from the viewpoint of bonding characteristics, it is preferable that the upper and lower end faces of the frame substrate 102 are polished (grinded) to form flat surfaces. In this way, it is possible to manufacture the frame substrate 102 formed with the through holes 132 having a high aspect ratio. The other members (selection circuit board 104 and liquid ejection unit 100) may be manufactured by various commonly known methods, and therefore description of these methods of manufacture is omitted here.

Figure 13D:
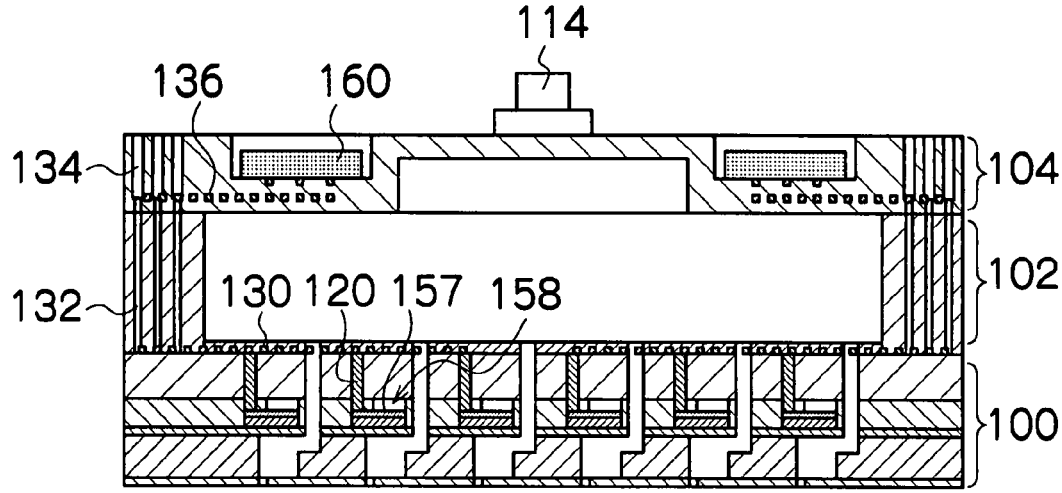

Next, alignment (position adjustment) is carried out so that the end portions of the electrical wires 130 of the liquid ejection unit 100, the through holes 132 of the frame substrate 102 and the connection holes 134 of the selection circuit board 104 correspondingly meet to each other. The liquid ejection unit 100, the frame substrate 102 and the selection circuit board 104 are then bonded together, as shown in FIG. 13D.

Thereupon, conductive paste is filled into the connection holes 134 and the through holes 132, and electrical connections are thereby formed simultaneously, between the electrical wires 136 and the connection electrodes 134, between the connection electrodes 134 and the through electrodes 132, and between the through electrodes 132 and the electrical wires 130. Thus, the output sides of the selection circuits 160 are electrically connected to the individual electrodes 157 of the piezoelectric elements 158.

Below, the method of filling conductive paste into the connection holes 134 and the through holes 132 is described with reference to FIGS. 14A to 14E showing steps of filling conductive paste.

Figure 14D:
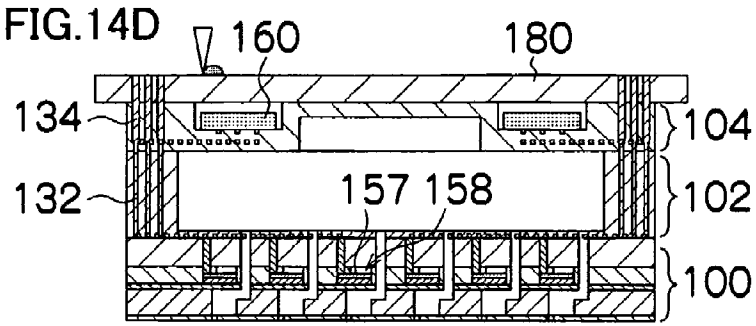
FIGS. 14A to 14E are process diagrams showing a method of creating electrical connections by filling conductive paste, according to an embodiment of the present invention.
Figure 14E:
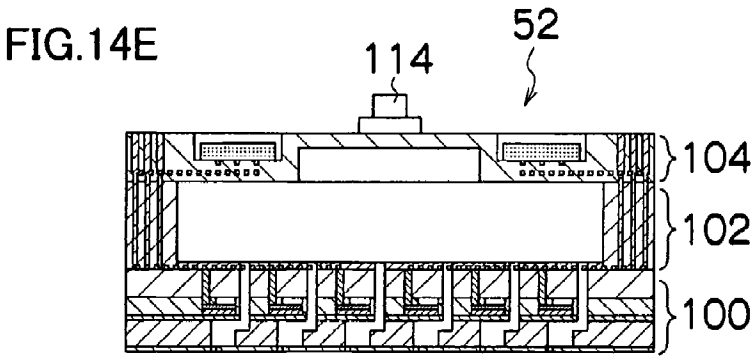
Figure 14A:
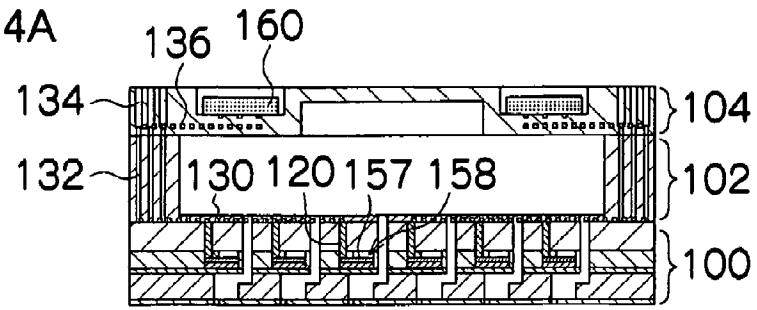
Figure 14B:
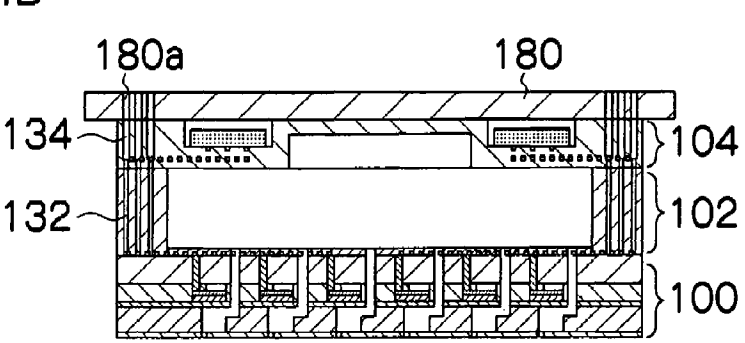

Firstly, when filling the conductive paste into the holes, as shown in FIG. 14A, it is required that the upper surface of the selection circuit board 104 be flat. This is because a mask 180 needs to be disposed on the upper surface of the selection circuit board 104, as shown in FIG. 14B. Therefore, before carrying out the step of filling conductive paste, the members constituting the ink supply ports 114, and the connectors, are temporarily removed. Alternatively, the constituent members of the ink supply ports 114 and the connectors are installed after completing the step of filling conductive paste, rather than installing these elements at the stage of individually manufacturing the selection circuit board 104.

Figure 14C:
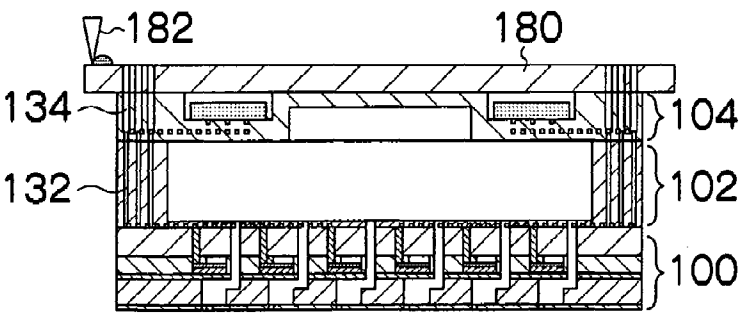

Thereupon, as shown in FIG. 14B, the mask 180 formed with hole sections 180*a* corresponding to the connection holes 134 in the selection circuit board 104 is arranged on the upper surface of the laminated body constituted of the liquid ejection unit 100, the frame substrate 102 and the selection circuit board 104 (in other words, on the upper surface of the selection circuit board 104), and this combined structure is then introduced into a vacuum chamber, and the pressure is temporarily reduced to vacuum (e.g., under a pressure from 30 Pa to 1000 Pa) by evacuating the interior of the chamber. In this state, as shown in FIG. 14C, conductive paste is placed on the mask 180 and screen printed by using a squeegee 182, thereby filling the conductive paste into the connection holes 134 and the through holes 132. This screen printing step may be repeated a plurality of times. Thereupon, the interior of the chamber is returned to the atmospheric pressure, and as shown in FIG. 14D, screen printing is carried out once again. Consequently, electrical connections are formed between the output sides of the selection circuits 160 and the individual electrodes 157 of the piezoelectric elements 158.

By filling the conductive paste into the connection holes 134 and the through holes 132 in the vacuum state in this way, then it is possible to remove the gas inside the connection holes 134 and the through holes 132, and hence good reliability of the electrical connections can be ensured. Moreover, when the interior of the chamber is returned to the atmospheric pressure, the conductive paste inside the connection holes 134 may assume a recessed shape due to the atmospheric pressure, but by carrying out the screen printing one more time, it is possible to eliminate any recesses at the connection holes 134. Furthermore, as described above with reference to FIGS. 8A and 8B, since the connection holes 134 are formed in a counterbored shape, then the land section (step section) 134*a* of the connection hole 134 has a large contact surface area with the conductive paste, and therefore it is possible to ensure even better reliability of the electrical connections.

Finally, the mask 180 is removed, prescribed insulation treatment is carried out on the surface of the selection circuit board 104, and the like. The constituent members of the ink supply ports 114, and the connectors, are then attached to the selection circuit board 104. Thus, the head unit 52 can be obtained as shown in FIG. 14E. Thereupon, as shown in FIG. 5, the print head 50 according to the present embodiment is completed by disposing a plurality of such head units 52 in prescribed positions in a staggered arrangement and then connecting these head units together. If the print head 50 is constituted of a single head unit 52, then this connection step is not necessary.

As described above, by filling the conductive paste into the connection holes 134 and the through holes 132, it is possible to simultaneously create the electrical connections in the head unit 52. Therefore, the number of steps required for the creating electrical connections can be reduced. Furthermore, the step of bonding the constituent members 100, 102 and 104 of the head unit 52, and the step of forming the electrical connections, are completely separated from each other, and therefore the reliability of these steps can be improved.

The method for simultaneously creating the electrical connections in the head unit 52 is not limited to a method including the step of filling conductive paste as described above. For example, another possible method is one which uses electrolytic plating. Below, a method using electrolytic plating is described with reference to process diagrams of FIGS. 15A to 15D.

In the case of using electrolytic plating, it is necessary to make the inner wall surfaces of the through holes 132 and the connection holes 134 electrically conductive, at the stage of individually manufacturing the frame substrate 102 and the selection circuit board 104. More specifically, the inner wall surfaces of the groove sections 172*a* of the wall members 172, which constitute the through holes 132, are rendered electrically conductive in advance, at the stage of manufacturing the frame substrate 102. Moreover, the inner wall surfaces of the connection holes 134 are rendered electrically conductive in advance by means of a commonly known technique for causing a through hole to be conductive.

Figure 15C:
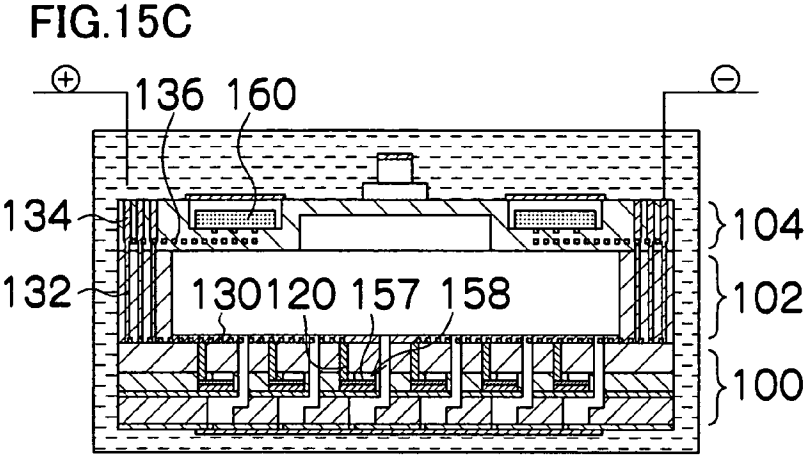
FIGS. 15A to 15D are process diagrams showing another method of creating electrical connections by using electrolytic plating, according to an embodiment of the present invention.
Figure 15D:
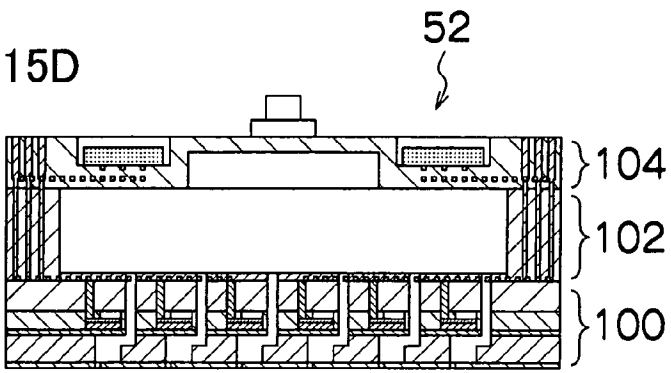
Figure 15A:
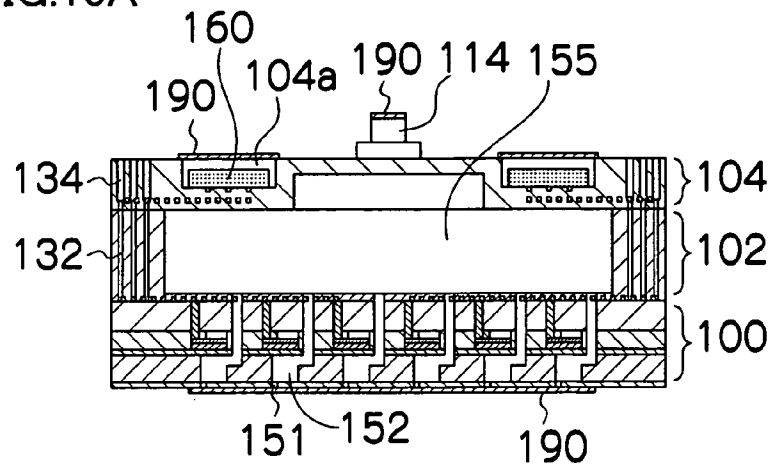

In a state where the inner wall surfaces of the through holes 132 and the connection holes 134 have been rendered electrically conductive, before immersing the laminated body constituted of the liquid ejection unit 100, the frame substrate 102 and the selection circuit board 104 in a plating solution, sealing members 190 are disposed in prescribed positions as shown in FIG. 15A in order to prevent the plating solution from entering into the pressure chambers 152 and the common liquid chamber 155 in the laminated body, and to prevent the selection circuits 160 from coming into contact with the plating solution. In FIG. 15A, the sealing members 190 are disposed to cover the openings of the nozzles 151, the groove sections 104*a* in which the selection circuits 160 are arranged, and the ink supply ports 114.

Figure 15B:
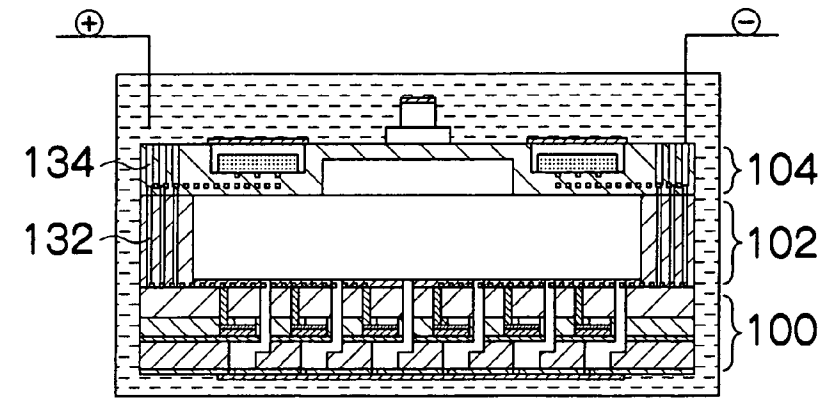

Next, the laminated body of the liquid ejection unit 100, the frame substrate 102 and the selection circuit board 104 is immersed in the plating solution, as shown in FIG. 15B, and a prescribed electric field is applied while applying an agitating action or ultrasonic wave in order for the plating solution to enter the connection holes 134 and the through holes 136. As stated previously, since the inner wall surfaces of the through holes 132 and the connection holes 134 have been rendered electrically conductive, then metal is deposited on these inner wall surfaces. The electrical connections are thereby created simultaneously between the electrical wires 136 and the connection electrodes 134, between the connection electrodes 134 and the through electrodes 132, and between the through electrodes 132 and the electrical wires 130, as shown in FIG. 15C.

Finally, as shown in FIG. 15D, the laminated body of the liquid ejection unit 100, the frame substrate 102 and the selection circuit board 104 is removed from the plating solution, and is then washed and dried. Thereupon, the sealing members 190 are removed, and consequently the head unit 52 is obtained.

In the case of the method using electrolytic plating, it is possible to simultaneously create the electrical connections in the head unit 52, and similar beneficial effects can be obtained to the case which uses filling of conductive paste.

According to the method of manufacture described above, it is possible to simultaneously create the electrical connections in the head unit 52, and hence the number of electrical connection steps can be reduced, in addition to which, the reliability of the electrical connections can be ensured.

In particular, it is possible to improve the reliability of the electrical connections of the through electrodes 134 having a high aspect ratio, formed in the frame substrate 102.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a liquid ejection unit which includes nozzles ejecting liquid, pressure chambers connected with the nozzles and filled with the liquid, and piezoelectric elements pressurizing the liquid in the pressure chambers;

a frame substrate which has a hole section passing through the frame substrate and is disposed on a side of the liquid ejection unit reverse to a side on which the nozzles are arranged, the hole section being defined with a lateral wall and corresponding to a common liquid chamber accumulating the liquid to be supplied to the pressure chambers;

a cover plate which is arranged on a side of the frame substrate reverse to a side adjacent to the liquid ejection unit; and through electrodes which pass through the lateral wall of the frame substrate and are exposed on the side adjacent to the liquid ejection unit and the side adjacent to the cover plate, wherein the piezoelectric elements are applied with drive signals via the through electrodes.

2. The liquid ejection head as defined in claim 1, wherein the frame substrate includes:

a frame member through which the hole section is formed; and a wall member which has grooves corresponding to the through electrodes and is bonded on a lateral face of the frame member.

3. The liquid ejection head as defined in claim 1, further comprising a selection circuit which is mounted on the cover plate and selects the piezoelectric elements to be applied with the drive signals.

4. The liquid ejection head as defined in claim 1, wherein the cover plate has a groove on a side adjacent to the common liquid chamber.

5. An image forming apparatus comprising the liquid ejection head as defined in claim 1.

6. A method of manufacturing a liquid ejection head including: a liquid ejection unit which includes nozzles ejecting liquid, pressure chambers connected with the nozzles and filled with the liquid, and piezoelectric elements pressurizing the liquid in the pressure chambers; a frame substrate which has a hole section passing through the frame substrate and is disposed on a side of the liquid ejection unit reverse to a side on which the nozzles are arranged, the hole section being defined with a lateral wall and corresponding to a common liquid chamber accumulating the liquid to be supplied to the pressure chambers; a cover plate which is arranged on a side of the frame substrate reverse to a side adjacent to the liquid ejection unit; and through electrodes which pass through the lateral wall of the frame substrate and are exposed on the side adjacent to the liquid ejection unit and the side adjacent to the cover plate, the piezoelectric elements being applied with drive signals via the through electrodes, the method comprising the steps of:

forming the liquid ejection unit, the frame substrate and the cover plate, independently of each other;

then bonding together the liquid ejection unit, the frame substrate and the cover plate; and then simultaneously and electrically connecting electrical wires of the liquid ejection unit with electrical wires of the cover plate via the through electrodes.

7. The method as defined in claim 6, wherein the connecting step includes the step of filling conductive paste into through holes corresponding to the through electrodes by vacuum printing.

8. The method as defined in claim 6, wherein the connecting step includes the step of applying electrolytic plating for through holes corresponding to the through electrodes.

9. The method as defined in claim 6, wherein the forming step includes the step of bonding a wall member which has grooves corresponding to the through electrodes onto a lateral face of the frame member through which the hole section is formed.

10. The method as defined in claim 9, wherein the forming step includes the step of forming at least one of the wall member and the frame member by die molding.

11. The method as defined in claim 9, wherein the forming step includes the step of forming the wall member by imprinting.

* * * * *